US008525057B2

(12) United States Patent
Mayer

(10) Patent No.: US 8,525,057 B2
(45) Date of Patent: Sep. 3, 2013

(54) SWITCHING UNIT FOR A CIRCUIT BREAKER HAVING A ROCKER LEVER

(75) Inventor: Siegfried Mayer, Gottmadingen (DE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 13/304,482

(22) Filed: Nov. 25, 2011

(65) Prior Publication Data

US 2012/0125750 A1 May 24, 2012

Related U.S. Application Data

(63) Continuation of application No. PCT/EP2010/057145, filed on May 25, 2010.

(30) Foreign Application Priority Data

May 25, 2009 (EP) ..... 09161024

(51) Int. Cl.
*H01H 3/04* (2006.01)

(52) U.S. Cl.
USPC ..... 200/335

(58) Field of Classification Search
USPC ..... 200/335, 329, 17 R, 50.02, 50.03, 200/50.1, 50.26, 553, 330, 333, 339; 335/17, 335/76; 337/79
See application file for complete search history.

(56) References Cited

U.S. PATENT DOCUMENTS 3,591,747 A * 7/1971 Dennison ..... 200/557
4,975,673 A 12/1990 Ikehata et al.
5,693,923 A 12/1997 Gula et al.
6,091,038 A * 7/2000 Murphy et al. ..... 200/563
8,188,389 B2 * 5/2012 Ogura ..... 200/16 A

FOREIGN PATENT DOCUMENTS

DE 102 44 237 A1 4/2003
EP 0 299 440 A2 1/1989
EP 0 801 411 A2 10/1997
EP 0 921 551 A1 6/1999

OTHER PUBLICATIONS

International Preliminary Report on Patentability (PCT/IB373) issued on Dec. 16, 2011, by European Patent Office as the International Searching Authority for International Application No. PCT/EP2010/057145.
Written Opinion of the International Searching Authority (PCT/ISA237) issued on Aug. 12, 2010, by European Patent Office as the International Searching Authority for International Application No. PCT/EP2010/057145.
International Search Report (PCT/ISA/210) issued on Aug. 12, 2010, by European Patent Office as the International Searching Authority for International Application No. PCT/EP2010/057145.
European Search Report issued on Nov. 17, 2010 (with English language translation of category of cited documents).

* cited by examiner

*Primary Examiner* — Edwin A. Leon
(74) *Attorney, Agent, or Firm* — Buchanan Ingersoll & Rooney PC

(57) ABSTRACT

An exemplary switching unit is disclosed for operation of a rocker lever of a circuit breaker, which is provided on the circuit breaker. The switching unit has a drive unit with a free-play distance, such that a slide of the drive unit, which slide is intended for operation of the rocker lever, does not impede the movement of the rocker lever.

19 Claims, 3 Drawing Sheets

SWITCHING UNIT FOR A CIRCUIT BREAKER HAVING A ROCKER LEVER

RELATED APPLICATION

This application claims priority as a continuation application under 35 U.S.C. §120 to PCT/EP2010/057145, which was filed as an International Application on May 25, 2010 designating the U.S., and which claims priority to European Application 09161024.6 filed in Europe on May 25, 2009. The entire contents of these applications are hereby incorporated by reference in their entireties.

FIELD

The invention relates to circuit breakers, such as automated circuit breakers which can be operated manually by rocker levers.

BACKGROUND

DE-A-102 44 231, for example, discloses a switching unit such as this. This known apparatus allows mechanical circuit breakers, which are intended to be operated manually, to be operated by remote control by a switching unit from a remote control center. For this purpose, this known apparatus has a driven claw for operation of a rocker switch on the circuit breaker. With this known apparatus, correct operation of the circuit breaker is not ensured if the claw is not moved away from the rocker lever.

EP-A-0 801 411 discloses a further switching unit.

SUMMARY

An exemplary switching unit for operation of a rocker lever of a circuit breaker is disclosed, comprising: a drive unit which has at least one driven first element which can be moved linearly through a distance, wherein the drive unit has a second element, which can move freely through a free-play distance with respect to the first element, and wherein the free-play distance is selected to ensure that operation of the rocker lever is not impeded by the switching unit.

An exemplary circuit breaker is disclosed, comprising: a rocker lever having a switching unit, which is fitted to the circuit breaker for operation of the rocker lever, wherein the switching unit includes: a drive unit which has at least one driven first element which can be moved linearly through a distance, wherein the drive unit has a second element, which can move freely through a free-play distance with respect to the first element, and wherein the free-play distance is selected to ensure that operation of the rocker lever is not impeded by the switching unit.

A method is disclosed for operation of a switching unit for operation of a rocker lever of a circuit breaker, wherein the switching unit includes a drive unit which has at least one driven first element which can be moved linearly through a distance, wherein the drive unit has a second element, which can move freely through a free-play distance with respect to the first element, and wherein the free-play distance is selected to ensure that operation of the rocker lever is not impeded by the switching unit, the method comprising moving the first element with catching of the second element being driven in a switching-on direction until the rocker lever reaches an "on" position; and moving the first element through a free-play distance in a switching-off direction, with the second element not being moved.

DESCRIPTION OF THE DRAWINGS

Embodiments of the invention will be explained in detail in the following text with reference to the drawing, in which, purely schematically.

Figure 1:
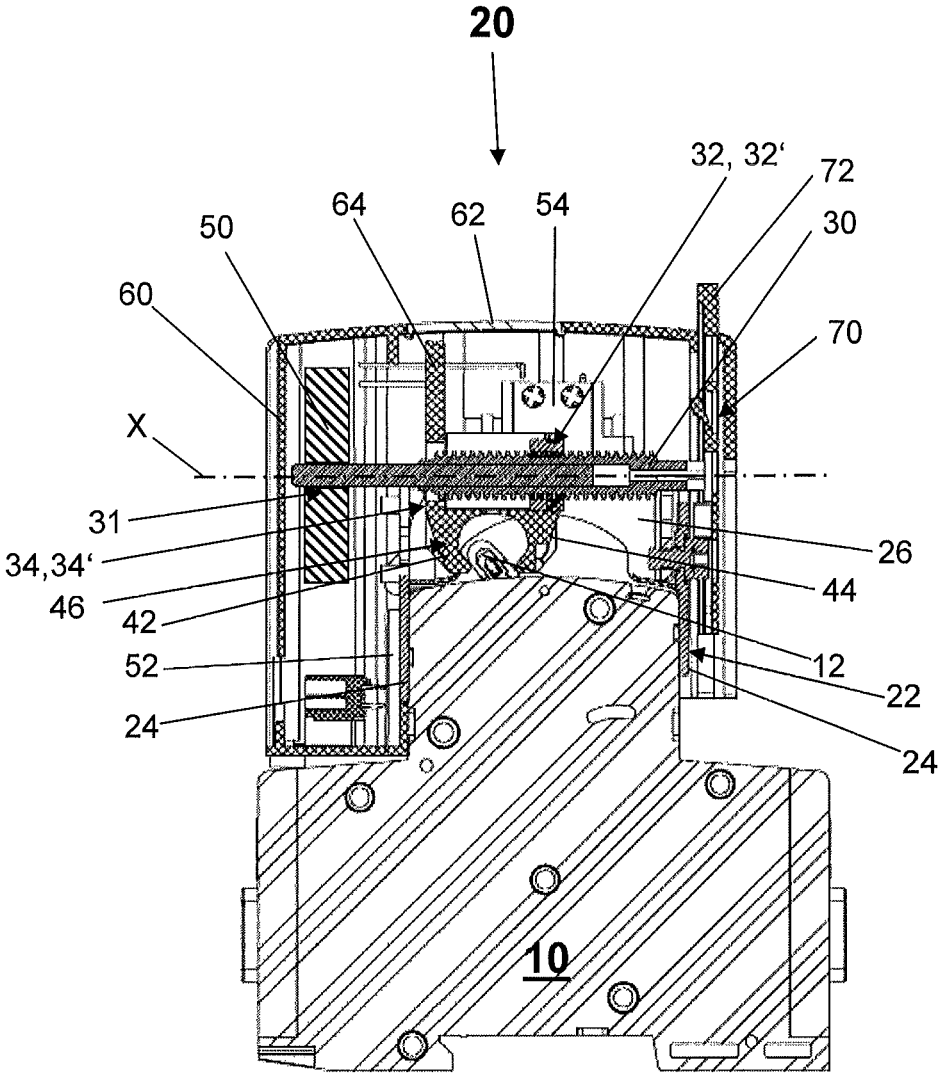
FIG. 1 shows a section view of a circuit breaker having a switching unit in accordance with an exemplary embodiment.

The reference symbols used in the drawing and their meaning are listed in summary form in the list of reference symbols. In principle, the same parts are provided with the same reference symbols in the figures. The described embodiments represent examples of the subject matter of the invention, and have no restrictive effect.

DETAILED DESCRIPTION

Exemplary embodiments of the present disclosure provide an apparatus of the type, which can ensure reliable operation of a circuit breaker.

In an exemplary embodiment, the switching unit for operation of a rocker lever of a circuit breaker has a drive unit that has at least one driven first element that can be moved linearly through a distance. The drive unit can also have a second element, which can move freely through a free-play distance with respect to the first element. This free-play distance makes it possible to ensure that the freedom of movement of the rocker lever is not restricted by the switching unit. This can ensure that the rocker lever of the circuit breaker can move freely, thus ensuring that there is no adverse effect on the operation of the circuit breaker.

In another exemplary embodiment, a method for operation of a switching unit for operation of a rocker lever of a circuit breaker, with the switching unit having a driven, linearly moving first element and a second element which interacts with the first element and can be moved along a distance by means of the first element, in which case, during a movement of the second element in the switching-on direction from the "off" position to the "on" position, and during a movement of the second element in the switching-off direction of the rocker lever from the "on" position to the "off" position, the rocker lever can be moved by means of the second element. The includes moving the first element with the second element being driven in the switching-on direction until the rocker lever reaches the "on" position; moving the first element through a free-play distance in the switching-off direction, with the second element not being moved.

The exemplary methods of the present disclosure provide for operation of a switching unit, which allows a circuit breaker, which has been developed for manual operation to be automated in a simple manner. Because of the exemplary method, the circuit breaker can be operated from a control center.

In an exemplary embodiment, the switching unit has a driven spindle, a spindle nut which interacts with the spindle and can be moved along the spindle by rotation of the spindle, and a slide which interacts with the spindle nut and can be moved along the spindle by means of the spindle nut, with the slide being designed for operation of the rocker lever, and with the slide being movable through the free-play distance relative to the spindle nut. The exemplary drive unit of the present disclosure allows a particularly simple refinement of the drive unit, which has a free-play distance. Since there is rotary movement on the drive side with respect to the spindle nut, an appropriate motor can be used, which specifies relatively little power for operation.

In another exemplary embodiment of the present disclosure, the switching unit includes a drive unit that can be blocked. As a result, during maintenance tasks the rocker lever of the circuit breaker cannot be operated by the switching unit. This serves in particular to protect the person who is carrying out the maintenance tasks.

FIG. 1 shows a section view of a circuit breaker having a switching unit in accordance with an exemplary embodiment. The circuit breaker 10 has a rocker lever 12, by means of which the electrical switching contacts of the circuit breaker 10 can be opened or disconnected. Circuit breakers 10 such as these can be used, for example, for voltages up to 1200 V and current levels up to 0.5 A. If the circuit breaker is subject to an unacceptable operating condition, for example, an excessively high voltage or an excessively high current level is present, the circuit breaker can automatically open the electrical switching contacts.

The rocker lever 12 of the circuit breaker 10 has three stable switching positions, an "off" position in which the electrical switching contacts are disconnected, an "on" position in which the electrical switching contacts are closed, and a "trip" position.

Figure 2:
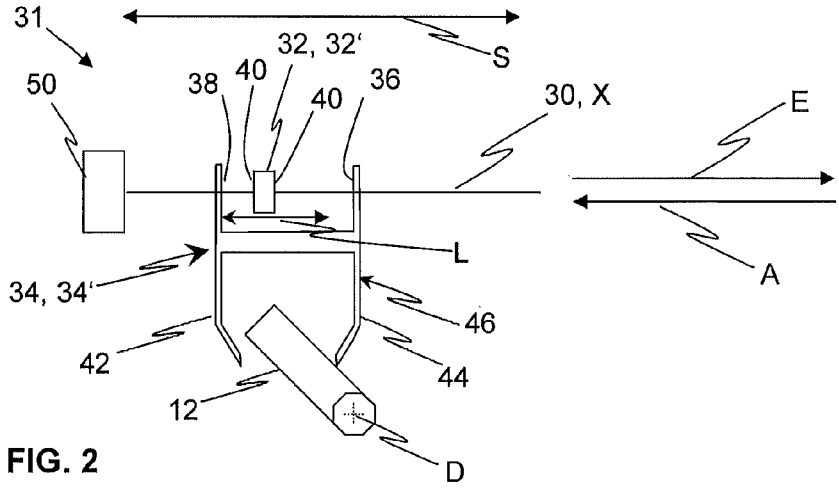
FIG. 2 shows a partial view of a switching unit and rocker switch of a circuit breaker having a rocker lever with a slide in accordance with an exemplary embodiment.

FIG. 2 shows a partial view of a switching unit and rocker switch of a circuit breaker having a rocker lever with a slide in accordance with an exemplary embodiment. As shown in FIG. 2, the rocker lever 12 can be moved manually in a switching-on direction E from the "off" position to the "on" position. During a manual movement in the switching-off direction A, the rocker lever can be moved from the "on" position to the "off" position. In the event of a fault, for example, when an unacceptable operating condition occurs, the electrical switching contact opens, and the rocker lever 12 is moved from the "on" position to a "trip" position, which is located between the "on" position and the "off" position of the rocker lever 12. This makes it possible for an operator viewing the circuit breaker 10 to determine whether the contacts of the circuit breaker 10 have or have not been opened because of an unacceptable operating condition. If the rocker lever 12 is in the "trip" position, the rocker lever 12 should first be moved to the "off" position to allow the electrical switching contacts to be closed by moving the rocker lever 12 from the "off" position to the "on" position.

In principle, circuit breakers do not specify the "trip" position although, in the case of circuit breakers such as these, it is not possible to determine whether the electrical contacts have been opened manually or because of an unacceptable operating condition. The exemplary embodiments of the present disclosure can be used for circuit breakers with a "trip" position and for circuit breakers without a "trip" position.

The movement of the rocker lever 12 from the "off" position to the "on" position, because of which the electrical switching contacts are closed, typically loads a spring. The energy that is stored in the spring can be used to open the electrical switching contacts in the event of a fault. When disconnecting the switching contacts, the contacts should be disconnected from one another quickly, such that an arc, which is struck between the switching contacts to be disconnected, is quenched quickly and the arc does not damage the circuit breaker.

Since the movement of the rocker lever 12 is coupled to the relative movement of the electrical switching contacts to be disconnected with respect to one another, during disconnection of the electrical switching contacts, the movement of the rocker lever 12 should not be impeded, in order that the circuit breaker 10 operates correctly. If the freedom of movement of the rocker lever 12 is impeded, it is not possible to ensure that the circuit breaker 10 will operate correctly in a desired, specified manner.

A switching unit 20 for automatic operation of the rocker lever 12 of the circuit breaker 10 is fitted to the circuit breaker 10. The switching unit 20 allows the rocker lever 12, which is designed for manual operation, to be operated automatically via the switching unit 20. As a result, the switching unit 20 is on the one hand supplied with its own current feed, and is connected via a data line to a control center or the like.

As shown in FIG. 1, the switching unit 20 has a supporting structure 22 that is formed by two clamping arms 24 and a bridge 26, which connects these clamping arms 24. The supporting structure 22 has studs (not shown) on the clamping arms 24, which studs engage in depressions that are formed on the housing of the circuit breaker 10. In another exemplary embodiment of the present disclosure, the supporting structure 22 can also be attached in a force-fitting manner to the housing of the circuit breaker 10. Further assembly options are likewise possible, for example by means of adhesive bonding.

For example, an exemplary drive unit 31 can be held on the supporting structure 22. The drive unit 31 converts a rotary movement to a linear movement, with the linear movement taking place along a distance S. The drive unit 31 has a first element 32' that moves through the distance S. Furthermore, according to the present disclosure, the drive unit 32 has a second element 34', which can move freely through a free-play distance L with respect to the first element 32'.

The first element 32' is formed by a driven spindle nut 32, and the second element 34' is formed by a slide 34, in which case the slide 34 can move freely through the free-play distance L relative to the spindle nut 32. By way of example, the free-play distance L has a minimum length from 1 mm to 3 mm, for example, and more preferably of 5 mm. A maximum length of the free-play distance L has, for example, a length up to 40 mm, such as 30 mm in some exemplary embodiments, and more preferably of 15 mm.

The rocker lever 12 of the circuit breaker 10 is operated by means of the second element 34' or the slide 34. Since, according to the present disclosure, the second element 34' or the slide 34 can move freely through the free-play distance L, the exemplary switching unit 20 of the present disclosure means that the operation of the circuit breaker 10 is not adversely affected, in particular that the correct operation of the rocker lever 12 is not impeded by the switching unit 20.

A driven spindle 30 of the drive unit 31 of the switching unit 20 is held on the supporting structure 22 such that it can rotate. An axial direction X of the spindle 30 runs at right angles to the rotation axis D of the rocker lever 12 of the circuit breaker 10. In particular, the axial direction X of the spindle 30 runs at least approximately in the direction of a linear movement direction of the rocker lever 12, which linear movement direction approximates to the circular movement path of the rocker lever 12, and therefore in the direction of the distance S.

The spindle nut 32 is fitted to the spindle 30 and is guided by the supporting structure 22 such that rotation of the spindle 30 about its own axis results in the spindle nut 32 being able to move in the axial direction X of the spindle 30, and therefore through the distance S. As a result, the drive unit 31 converts a rotary movement to a linear movement, by means of the driven spindle 30 and the spindle nut 32.

Furthermore, the switching unit 20 has the slide 34, which is associated with the drive unit 31, can move in the axial direction X of the spindle 30, and is guided by the supporting structure 22. The slide 34 surrounds the spindle 30 in the circumferential direction of the spindle 30. In the axial direction X of the spindle 30, the slide 34 has a first mating contact surface 36 and a second mating contact surface 38, which interact at times with contact surfaces 40 which are formed on the end face on the spindle nut 32, in order to move the slide in the axial direction X. The first mating contact surface 36 is separated from the second mating contact surface 38 by a distance in the axial direction X which is greater than the distance between the contact surfaces 40 and the spindle nut 32. The free-play distance L is formed on the drive unit 31 by the distance between the first mating contact surface 36 and the second mating contact surface 38, which is greater than the distance between the contact surfaces 40.

Furthermore, the slide 34 is designed to operate the rocker lever 12 of the circuit breaker 10. For this purpose, the slide 12 has two drivers 42, 44, with the first driver 42 being intended to operate the rocker lever 12 in the switching-on direction E, and with the second driver 44 being intended to operate the rocker lever 12 in the switching-off direction A. The switching-on direction E is defined by the switching-on movement of the rocker lever 12 from its "off" position in the direction of the "on" position. The switching-off direction A is defined by the switching-off movement of the rocker lever from its "on" position in the direction of the "off" position. In an exemplary embodiment of the present disclosure, the first driver 42 and the second driver 44 are integral components of a claw 46, which is intended to clasp the rocker lever 12.

The spindle 30 is driven by a motor 50. The rotary movement of the motor 50 is converted via the spindle 30 and the spindle nut 32 to a linear movement in the axial direction X. The motor 50 is controlled by control logic 52 for the circuit breaker 10.

In order to allow the switching unit 20 to detect the "trip" position of the circuit breaker, the switching unit 20 has a pushbutton 54. When the rocker lever 12 moves the slide 34 to its position, which corresponds to the "trip" position, the pushbutton 54, is closed, as a result of which a signal is emitted to the control logic 52, until the slide 34 leaves the position which corresponds to the "trip" position. With every movement of the slide 34 from the position of the slide 34 which corresponds to the "off" position to the position of the slide 34 which corresponds to the "on" position, the pushbutton 54 likewise passes a signal to the control logic 52, since the pushbutton 54 is briefly closed and opened. A signal is likewise passed to the control logic if the slide 34 is moved in the opposite direction.

The supporting structure 22 and the elements held on it are at least partially enclosed in a housing 60 of the switching unit 20. The housing 60 has a viewing window 62, through which the position of the slide 34 in the axial direction X of the spindle 30 is indicated. For this purpose, the slide 34 has an indicating needle 64. The indicating needle 64 makes it possible for a user to tell whether the rocker lever 12 is in the "on" position, the "off" position or in the "trip" position.

A maximum possible movement distance of the slide 34 in the axial direction X of the spindle 30 is preferably chosen to be greater than an operating distance of the rocker lever 12 from the "on" position to the "off" position of a specific type of circuit breaker. This makes it possible for the switching unit 20 to be fitted to different types of circuit breakers.

Figure 9:
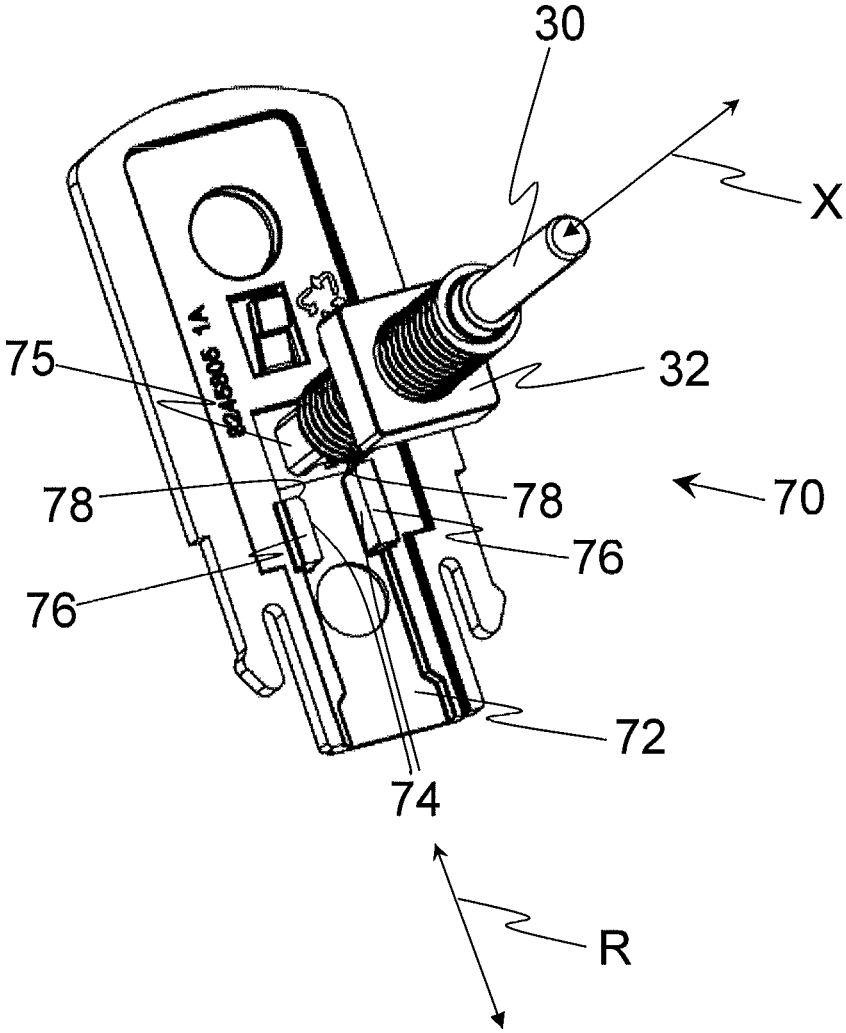
FIG. 9 shows a partial view of a switching unit of a blocking apparatus for blocking a spindle in accordance with an exemplary embodiment.

Furthermore, a blocking apparatus 70, as shown in FIGS. 1 and 9, for the spindle 30 is arranged on the housing 60. This blocking apparatus 70 makes it possible to mechanically prevent the operation of the circuit breaker 10 via the switching unit 20. This is particularly important for maintenance tasks on a circuit that is protected by the circuit breaker.

FIG. 9 shows a partial view of a switching unit of a blocking apparatus for blocking a spindle in accordance with an exemplary embodiment. As shown in FIG. 9, the blocking apparatus 70 is formed by a blocking slide 72 that is held on the housing 60 and has two locking surfaces 74, which interact with the spindle 30 in order to block it. The blocking slide 72 can be moved backward and forward from an unlocking position to a locking position, in a direction R at right angles to the axial direction X of the spindle 30. In the locking position, the blocking slide 72 can be locked in its position, for example by means of a padlock. Furthermore, a screw which is intended for fitting the switching unit 20 to the circuit breaker 10, for example a screw for fixing the switching unit 20 to the circuit breaker 10, can be arranged such that, when the blocking slide 72 is in the locking position, the screw is not accessible for fitting or removing the switching unit 20 to or from the circuit breaker 10.

The spindle 30 has a quadrilateral shape on its end area 75 that is remote from the motor 50. The two locking surfaces 74 are arranged on two projections 76, which are formed on the blocking slide 72. Movement of the blocking slide 72 at right angles to the axial direction X of the spindle 30 results in the end area 75 of the spindle 30 moving between the two locking surfaces 74, with these locking surfaces 74 resting on two side surfaces of the quadrilateral end area 75, thus blocking the spindle 30.

In order to allow the blocking apparatus 70 to be moved reliably from its unlocked position, in which the locking surfaces 74 are remote from the spindle 30, to the locked position, in which the locking surfaces 74 rest on the side surfaces of the quadrilateral end area 75 of the spindle 30, in any rotation position of the spindle 30, the blocking slide 72 has an apparatus which rotates the spindle 30—if necessary—such that the locking surfaces 74 are aligned parallel to two side surfaces of the quadrilateral end area 75. For this purpose, a surface 78 for alignment of the spindle is provided on each of the projections 76, on that side which faces the spindle 30 when the blocking slide 72 is in the unlocked position. The surfaces 78 are arranged offset with respect to one another, for example, not opposite one another, in the movement direction R of the blocking slide 72. This prevents the spindle 30 from sticking to an insertion into the blocking apparatus 70.

The spindle 30, and in consequence the drive unit 31, can be blocked by the described blocking apparatus 70.

The circuit breaker 10 can be operated as follows.

Before the switching unit 20 is fitted to the circuit breaker 10, the rocker lever 12 of the circuit breaker 10 is in its "off" position. As shown in FIG. 2, the switching unit 20 is fitted to the circuit breaker 10 such that the claw 46 clasps the rocker lever 12.

Before the switching unit 20 can reliably operate the rocker lever 12, without adversely affecting the operation of the circuit breaker 10, the switching unit 20 is calibrated for the respective circuit breaker 10.

Figure 3:
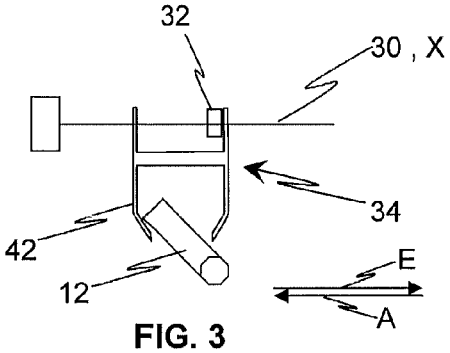
FIG. 3 shows a partial view of a circuit breaker having a switching unit and rocker lever in an "off" position and a slide in an "off" position in accordance with an exemplary embodiment.

FIG. 3 shows a partial view of a circuit breaker having a switching unit and rocker lever in an "off" position and a slide in an "off" position in accordance with an exemplary embodiment. As shown in FIG. 3, the rotation of the motor 50, the rotation of the spindle 30 which is coupled to the rotation of the motor 50, and the linear movement of the spindle nut 32 caused by the rotation of the spindle 30 result in the slide 34 being moved from its initial position in the switching-on direction E to that position in which the first driver 42 touches the rocker lever 12. This position is detected by monitoring a load current of the motor 50, which drives the spindle 30. As soon as the first driver 42 touches the rocker lever 12, and because the rocker lever 12 can be moved from the "off" position only by exerting force, the load current rises suddenly. This position of the slide, in which the first driver 42 rests on the rocker lever 12 in its "off" position, is referred to as the "off" position of the slide 34.

The "off" position of the slide 34 is preferably moved twice in the switching-on direction E, in order to reference this position.

Figure 4:
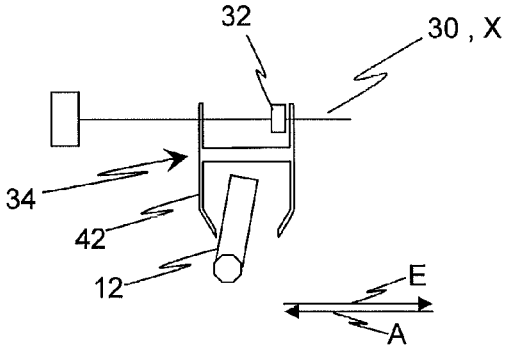
FIG. 4 shows a partial view of a circuit breaker having a switching unit and rocker lever with the slide being shown during a switching-on movement in accordance with an exemplary embodiment.

FIG. 4 shows a partial view of a circuit breaker having a switching unit and rocker lever with the slide being shown during a switching-on movement in accordance with an exemplary embodiment. As shown in FIG. 4, in order to move the rocker lever 12 from its "off" position to its "on" position, the slide 34 is moved further in the switching-on direction E. In the process, the rocker lever 12 jumps to its "on" position.

Figure 5:
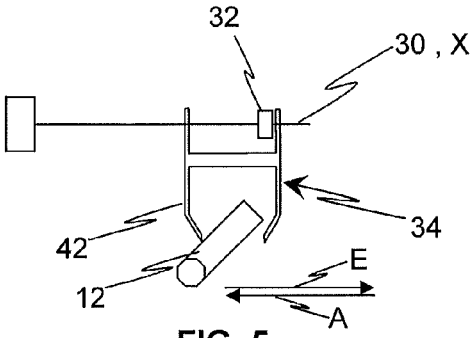
FIG. 5 shows a partial view of a circuit breaker having a switching unit and a rocker lever in an "on" position and the slide being shown in an extreme position in the switching-on direction in accordance with an exemplary embodiment.

FIG. 5 shows a partial view of a circuit breaker having a switching unit and a rocker lever in an "on" position and the slide being shown in an extreme position in the switching-on direction in accordance with an exemplary embodiment. As shown in FIG. 5, the slide 34 is moved in the switching-on direction E until the first driver 42 makes contact with the rocker lever 12 in its "on" position (see FIG. 5). This position can once again be detected by measurement of the load current, and is referred to as the extreme position of the slide 34 in the switching-on direction E.

Figure 6:
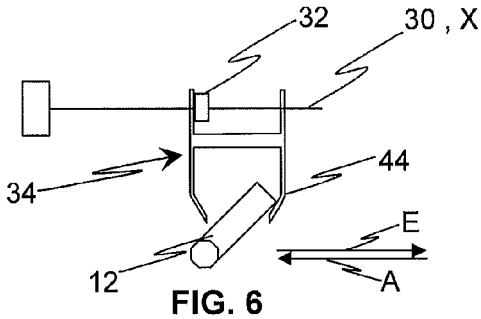
FIG. 6 shows a partial view of a circuit breaker having a switching unit and rocker lever in an "on" position and the slide likewise being shown in its "on" position in accordance with an exemplary embodiment.

FIG. 6 shows a partial view of a circuit breaker having a switching unit and rocker lever in an "on" position and the slide likewise being shown in its "on" position in accordance with an exemplary embodiment. In order to avoid adversely affecting the operation of the circuit breaker 10, it is desirable to release the rocker lever 12 in its "on" position, such that the rocker lever 12 can rock to the "trip" position when the circuit breaker detects a fault situation—or can rock directly to the "off" position if the circuit breaker does not have a "trip" position. For this purpose, the motor 50 is operated in the opposite rotation direction to the rotation direction of the motor 50 for movement of the slide 34 into the switching-on direction E, as a result of which the spindle nut 32 is moved away from the first mating contact surface 36 of the slide 34, in the switching-off direction A. While the spindle nut 32 is being moved toward the second mating contact surface 38, the slide 34 is first locked in the extreme position in the switching-on direction E. As soon as the spindle nut 32 touches the second mating contact surface 38, the slide 34 is moved in the switching-off direction A. As shown in FIG. 6, the slide 34 can, for example, be moved until the second driver 44 of the slide 34 makes contact with the rocker lever 12 in its "on" position. This position of the slide 34 can once again be detected by measurement of the load current. This position of the slide 34, in which the second driver 44 rests on the rocker lever 12 in the "on" position, is referred to as the "on" position of the slide 34.

The "off" position and the "on" position of the slide 34 are stored in the control logic 52 as absolute positions by counting Hall sensor signals with respect to one another, thus making it possible to move directly to these positions. Furthermore, the two extreme positions in the switching-on direction E and in the switching-off direction A can also be determined by measurement of the load current, and can be stored. This makes it possible to prevent the motor 50 from inadvertently moving to a mechanical stop, and thus being overloaded.

After the calibration of the switching unit 20, which has been fitted to the circuit breaker 10, the switching unit 20 operates as follows.

As shown in FIGS. 3, 4, 5, and 6, when the switching unit 20 receives a switch-on signal from the control center, the slide 34 is moved via the extreme position in the switching-on direction E to the "on" position.

Figure 8:
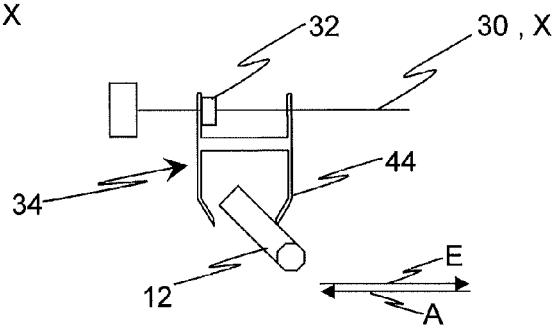
FIG. 8 shows a partial view of a circuit breaker having a switching unit and rocker lever in an "off" position and the slide in an extreme position in the switching-off direction in accordance with an exemplary embodiment.

FIG. 8 shows a partial view of a circuit breaker having a switching unit and rocker lever in an "off" position and the slide in an extreme position in the switching-off direction in accordance with an exemplary embodiment. FIGS. 3, 6, and 8 illustrate that when the switching unit 20 receives a switch-off signal from the control center, the slide 34 is moved via the extreme position in the switching-off direction A to the "off" position. As a result, of the movement of the slide via the respective extreme position in the switching-on direction E or in the switching-off direction A to the "on" position or, respectively, to the "off" position, the system comprising the circuit breaker 10 and the switching unit 20 is directly ready to carry out a further switching command from the control center.

Figure 7:
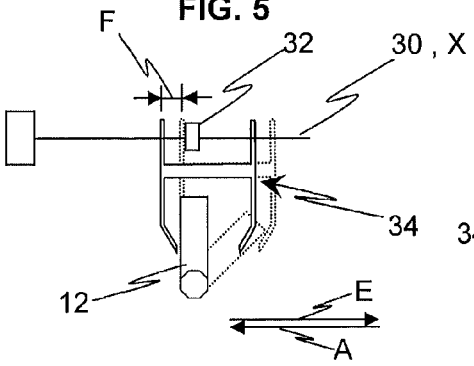
FIG. 7 shows a partial view of a circuit breaker having a switching unit and rocker lever in a "trip" position in accordance with an exemplary embodiment.

FIG. 7 shows a partial view of a circuit breaker having a switching unit and rocker lever in a "trip" position in accordance with an exemplary embodiment. As shown in FIGS. 6 and 7, if the switching unit 20 is in the "on" position and, in consequence, the electrical contact in the circuit breaker 10 is closed, the rocker lever 12 should be able to pivot freely from the "on" position to the "trip" position in the event of a fault. This is desirable because interference-free operation of the circuit breaker 10 would not be ensured if there were any impediments to the free movement of the rocker lever 12. In particular, the circuit breaker 10 and/or the electrical devices to be protected could be damaged and/or destroyed.

As shown in FIGS. 6 and 7 (the "on" position is shown by dotted lines), this free movement of the rocker lever 12 from the "on" position to the "trip" position (see FIG. 7) is achieved by the free-play distance L (illustrated in FIG. 2) of the slide 34 relative to the spindle nut 32. When the slide 34 is in the "on" position, the spindle nut 32 rests on the second mating contact surface 38 of the slide 34. FIG. 7 illustrates that when the rocker lever 12 moves from the "on" position to the "trip" position, the slide 34 is moved by the moving rocker lever 12 in the switching-off direction A through the fault movement distance F. This movement is not impeded by the spindle nut 32 because of the free-play distance L between the first mating contact surface 36 and the second mating contact surface 38. In consequence, the operation of the circuit breaker 12 can be ensured.

If the rocker lever has a "trip" position, the free-play distance L is designed such that, when the rocker lever 12 moves from the "on" position to the "trip" position, the spindle nut 32 does not come into contact with the first mating contact surface 36 since, otherwise, correct operation of the circuit breaker 10 would not be ensured. If the rocker lever does not have a "trip" position, that is to say if the rocker lever 12 pivots directly from the "on" position to the "off" position in the event of a fault, the free-play distance L is designed (i.e., configured) such that, when the rocker lever 12 moves from the "on" position to the "off" position, the spindle nut 32 does not make contact with the first mating contact surface 36 since, otherwise, the correct operation of the circuit breaker 10 would not be ensured.

In other words, in the event of a fault, the rocker lever 12 operates the second element 34', which in the exemplary embodiment is formed by the slide 34. In the process, the second element 34' is moved through the fault movement distance F in the switching-off direction A. In order to prevent this movement of the second element 34' that is caused by the rocker lever 12 in the event of a fault from adversely affecting the operation of the circuit breaker 10, as has already been described, the free-play distance L is chosen to be at least as great as the fault movement distance F. For example, the free-play distance L can be chosen to be greater than the fault movement distance F.

As shown in FIG. 1, the "trip" position of the slide 34, and in consequence of the rocker lever 12, is fixed by means of the pushbutton 54. The pushbutton 54 is positioned in the axial direction X of the spindle 34 such that the pushbutton 54 produces a continuous signal when the slide 34 is in the "trip" position. The signal from the pushbutton 54 is passed on by the control logic 52 to a remote control center for controlling the switching unit 20.

After the circuit breaker 10 has been switched off because of a fault, that is to say when the rocker lever 12 has been automatically moved from the "on" position to the "trip" position, and after a switch-on command initiated by the control center, in response to which the slide 34 is moved via the extreme position in the switching-off direction A to the "on" position, it is possible that the fault in the circuit which is protected by the circuit breaker has not been rectified. In consequence, the circuit breaker 10 will once again detect a fault and will immediately open the electrical contacts; as a result, the rocker lever 12 is once again moved from the "on" position to the "trip" position.

An attempt such as this to switch on the circuit breaker 10 while a fault is present in the circuit to be protected, for example because of a short in the circuit to be protected, should not be carried out indefinitely often in a short time interval, since the circuit breaker 12 and/or the switching unit 20 could otherwise be damaged. The control logic 52 is therefore designed such that only a limited number of switching-on processes are carried out in a certain time interval.

In another exemplary embodiment, which is not shown in the drawing, the drive unit of the switching unit has a linear motor. This linear motor is used instead of a motor, as disclosed in relation with the other exemplary embodiments, the spindle, which is caused to rotate by means of the motor, and the spindle nut that is driven by the spindle. A linearly driven first element of the linear motor forms an element that acts in an equivalent manner to the spindle nut and interacts with the slide. Otherwise, this exemplary embodiment is designed (i.e., configured) in a similar manner to the other exemplary embodiments, and is likewise operated in a similar manner to the other exemplary embodiments.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

| | |
|---|---|
| 10 | Circuit breaker |
| 12 | Rocker lever |
| 20 | Switching unit |
| 22 | Supporting structure |
| 24 | Clamping arms |
| 26 | Bridge |
| 28 | Stud |
| 30 | Spindle |
| 31 | Drive unit |
| 32 | Spindle nut |
| 34 | Slide |
| 36 | First mating contact surface |
| 38 | Second mating contact surface |
| 40 | Contact surfaces |
| 42 | First driver |
| 44 | Second driver |
| 46 | Claw |
| 50 | Motor |
| 52 | Control logic |
| 54 | Pushbutton |
| 60 | Housing |
| 62 | Viewing window |
| 64 | Indicating needle |
| 70 | Blocking apparatus |
| 72 | Blocking slide |
| 74 | Locking surfaces |
| 75 | End area of the spindle |
| 76 | Projections |
| 78 | Surface |
| A | Switching-off direction |
| D | Rotation axis of the rocker lever |
| E | Switching-on direction |
| F | Fault movement distance |
| L | Free-play distance |
| X | Axial direction of the spindle |

What we claim is:

1. A switching unit for operation of a rocker lever of a circuit breaker, comprising:

a drive unit which has at least one driven first element which is configured to move linearly through a distance, and a second element, which is configured to move freely through a free-play distance with respect to the first element; and a rocker lever connected to the drive unit, wherein the free-play distance is selected to ensure that operation of the rocker lever is not impeded by the switching unit, and wherein the rocker lever is configured to move through a fault movement distance from an "on" position in the direction of an "off" position, and the free-play distance is at least equal to the fault movement distance.

2. The switching unit as claimed in claim 1, in combination with a rocker lever of a circuit breaker, wherein the second element is provided for operating the rocker lever of the circuit breaker.

3. The switching unit as claimed in claim 1, wherein the drive unit has a driven spindle, and a spindle nut which interacts with the spindle, the spindle nut being moveable along the driven spindle by rotation of the spindle and forming the first element, and wherein the drive unit includes a slide for interacting with the spindle nut, which slide is moveable along the spindle via the spindle nut and forms the second element, and with the slide will operate a rocker lever.

4. The switching unit as claimed in claim 3, wherein the slide has a first mating contact surface and a second mating contact surface which are separated from one another in an axial direction of the spindle, with the first mating contact surface or the second mating contact surface, respectively, interacting with the spindle nut for movement of the slide in the axial direction of the spindle, with a distance between the first mating contact surface and the second mating contact surface being chosen such that the spindle nut will interact at most with one of the two mating contact surfaces at a same time.

5. The switching unit as claimed in claim 4, wherein the distance between the first mating contact surface and the second mating contact surface in an axial direction of the spindle is greater than a length of the spindle nut in the axial direction of the driven spindle.

6. The switching unit as claimed in claim 3, wherein a movement distance of the slide in the axial direction of the spindle is chosen to be greater than an operating distance of the rocker lever.

7. The switching unit as claimed in claim 1, wherein the drive unit is driven by a linear motor, with an element which is driven by the linear motor forming the first element, and with the drive unit having a slide which interacts with the driven, first element and forms the second element, and with the slide being configured to operate a rocker lever.

8. The switching unit as claimed in claim 1, wherein the drive unit can be blocked.

9. A circuit breaker, comprising:

a rocker lever having a switching unit, which is fitted to the circuit breaker for operation of the rocker lever, wherein the switching unit includes:

a drive unit which has at least one driven first element which can be moved linearly through a distance, wherein the drive unit has a second element, which can move freely through a free-play distance with respect to the first element, wherein the free-play distance is selected to ensure that operation of the rocker lever is not impeded by the switching unit, and wherein the rocker lever of the switching unit is configured to be moved through a fault movement distance from an "on" position in the direction of an "off" position, and the free-play distance is at equal to the fault movement distance.

10. The switching unit as claimed in claim 2, wherein in an event of a fault, the rocker lever of the switching unit is moved through a fault movement distance from an "on" position in the direction of an "off" position, and the free-play distance is chosen to be at least as great as the fault movement distance.

11. The switching unit as claimed in claim 2, wherein the drive unit has a driven spindle, and a spindle nut which interacts with the driven spindle, the spindle nut being moveable along the driven spindle by rotation of the driven spindle and forming the first element, and wherein the drive unit includes a slide for interacting with the spindle nut, which slide is moveable along the driven spindle via the spindle nut and forms the second element, and with the slide will operate the rocker lever.

12. The switching unit as claimed in claim 1, wherein the drive unit has a driven spindle, and a spindle nut which interacts with the driven spindle, the spindle nut being moveable along the driven spindle by rotation of the driven spindle and forming the first element, and wherein the drive unit includes a slide for interacting with the spindle nut, which slide is moveable along the driven spindle via the spindle nut and forms the second element, and with the slide will operate a rocker lever.

13. The switching unit as claimed in claim 4, wherein a movement distance of the slide in the axial direction of the spindle is chosen to be greater than an operating distance of the rocker lever.

14. The switching unit as claimed in claim 5, wherein a movement distance of the slide in the axial direction of the spindle is chosen to be greater than an operating distance of the rocker lever.

15. The switching unit as claimed in claim 2, wherein the drive unit is driven by a linear motor, with an element which is driven by the linear motor forming the first element, and with the drive unit having a slide which interacts with the driven, first element and forms the second element, and with the slide being configured to operate the rocker lever.

16. The switching unit as claimed in claim 1, wherein the drive unit is driven by a linear motor, with an element which is driven by the linear motor forming the first element, and with the drive unit having a slide which interacts with the driven, first element and forms the second element, and with the slide being configured to operate a rocker lever.

17. The switching unit as claimed in claim 2, wherein the drive unit can be blocked.

18. The switching unit as claimed in claim 1, wherein the drive unit can be blocked.

19. A method for operation of a switching unit for operation of a rocker lever of a circuit breaker, wherein the switching unit includes a drive unit which has at least one driven first element which can be moved linearly through a distance, wherein the drive unit has a second element, which can move freely through a free-play distance with respect to the first element, and wherein the free-play distance is selected to ensure that operation of the rocker lever is not impeded by the switching unit, the method comprising:

moving the first element with catching of the second element being driven in a switching-on direction until the rocker lever reaches an "on" position;

moving the first element through a free-play distance in a switching-off direction, with the second element not being moved;

in an event of a fault, moving the rocker lever of the switching unit through a fault movement distance from an "on" position in the direction of an "off" position; and selecting the free-play distance to be at least equal to the fault movement distance.

* * * * *